US006357547B1

(12) United States Patent
Kellog et al.

(10) Patent No.: US 6,357,547 B1
(45) Date of Patent: Mar. 19, 2002

(54) POLE HITCHING DEVICE

(76) Inventors: Everett H. Kellog; Veronica Kellog-Cole, both of HC 70 Box 21, Jasper, AR (US) 72641

( * ) Notice: Subject to any disclaimer, the term of this patent is extended or adjusted under 35 U.S.C. 154(b) by 0 days.

(21) Appl. No.: 09/286,686

(22) Filed: Apr. 5, 1999

(51) Int. Cl.[7] ..... H62B 35/00
(52) U.S. Cl. ..... 182/9
(58) Field of Search ..... 189/9, 129; D2/962

(56) References Cited

U.S. PATENT DOCUMENTS

| | | | | | |
|---|---|---|---|---|---|
| 572,751 | A | * | 12/1896 | Hanna | |
| 2,166,958 | A | * | 7/1939 | Lawson | 36/129 |
| 2,604,250 | A | | 7/1952 | Trimble | 227/27 |
| 2,920,714 | A | | 1/1960 | Johnson | |
| 4,407,391 | A | | 10/1983 | Greenway et al. | 182/9 |
| 4,506,762 | A | | 3/1985 | Bednar | 182/221 |
| 4,579,196 | A | * | 4/1986 | Allen | 182/9 |
| 4,809,813 | A | * | 3/1989 | Stoddart | 182/19 |
| D324,130 | S | | 2/1992 | Matsumoto | D2/317 |
| 5,184,696 | A | | 2/1993 | Meed et al. | 182/9 |
| 5,222,991 | A | | 6/1993 | Bell | 182/9 |
| 5,234,074 | A | | 8/1993 | Bell | 182/9 |
| D385,045 | S | | 10/1997 | Vanselous | D25/69 |
| 5,738,046 | A | | 4/1998 | Williams | 119/770 |

* cited by examiner

*Primary Examiner*—Alvin Chin-Shue
(74) *Attorney, Agent, or Firm*—John D. Gugliotta

(57) ABSTRACT

Safety lanyards and belts are commonly used by linesman for use in climbing utility pole and by timber men for climbing trees. Typically such an apparatus is designed to encircle the tree and attach at both ends to the belt of the climber. Such lanyards and belts may even have teeth or spikes to improve the grip on the pole. For safety lanyards or belts which do not have such teeth, or to improve upon ones that do, an improved pole hitching device is provided. The device consists of basically a strap fastened to the interior surface of a conventional safety lanyard or belt with hook and loop fastener Velcro straps. The strap has a plurality of gripping cleats which dramatically improve the gripping power of the lanyard or belt.

1 Claim, 7 Drawing Sheets

POLE HITCHING DEVICE

RELATED APPLICATIONS

The present invention was first described in Disclosure Document filed on Jan. 8, 1999. There are no previously filed, nor currently any co-pending applications, anywhere in the world.

BACKGROUND OF THE INVENTION

1. Field of the Invention

The present invention relates generally to safety devices and, more particularly, to an improved gripping means for poles, especially when icy, for use with existing pole climbing lanyards commonly used by telephone linemen, timbermen and others when ascending and descending poles and trees.

2. Description of the Related Art

In the related art, it is well known that safety lanyards and belts for use in ascending utility poles and trees exist. Typically, a safety belt extending round the outer face of the pole and extending round the waist of the climber and/or attached to the climber's belt give the climber support while ascending and descending the pole. The belt must be capable of supporting nearly the full weight of the climber and be able to grip the pole should the climber lose footing on the pole. Many designs improve the performance of the belt by putting additional gripping means such as teeth or blocks on the inner surface of the belt that contacts the pole. The present invention is an improved gripping means of this type designed to be used with conventional existing safety lanyards and belts.

A search of the prior art did not disclose any patents that read directly on the claims of the instant invention; however, the following references were considered related:

| U.S. Pat. No. | Inventor | Issue Date |
|---|---|---|
| 2,604,250 | Trimble | July 22, 1952 |
| 2,920,714 | Johnson | January 12, 1960 |
| 4,407,391 | Greenway, et al. | October 4, 1983 |
| 4,579,196 | Allen, et al. | April 1, 1986 |
| 4,506,762 | Bednar | March 26, 1985 |
| 5,222,991 | Bell | June 29, 1993 |
| 5,184,696 | Meed, et al. | February 9, 1993 |
| 5,234,074 | Bell | August 10, 1993 |
| 5,738,046 | Williams, et al. | April 14, 1998 |

Of considerable relevance are U.S. Pat. No. 2,920,714 issued to Johnson, U.S. Pat. No. 4,579,196 issued to Allen, and U.S. Pat. No. 5,184,696 issued to Meed, et al. These patents disclose a safety device for pole climber's consisting of a strap having inwardly extending teeth on the inner surface of the strap to grip the pole. Somewhat relevant are U.S. Pat. No. 5,222,991 issued to Bell and U.S. Pat. No. 5,234,074 issued to Bell. These patents disclose a safety lanyard with gripping units having teeth installed on the belt for improved grip on the pole.

However, each of the aforementioned patents have a relatively small number of teeth or appendages providing the gripping means like the present invention. Nor can any of the cited references be used to retrofit existing safety lanyards or belts. The present invention provides an improved gripping means over the cited references in that it has a plurality of gripping cleats spaced such that a greater area of the belt is provided with cleats. In addition, it can be readily purchased and can be used with existing conventional safety lanyards and belts.

SUMMARY OF THE INVENTION

It is therefore an object of the present invention to provide an improved gripping means for safety lanyards and belts of the type typically used by pole climbers such as linesmen and timber men.

It is a feature of the present invention to be readily purchased and used with conventional existing safety lanyards and belts.

It is another feature of the invention to be easy to use and install.

Briefly described according to one embodiment of the present invention, a pole hitching device is provided comprised of a strap made from several layers of high strength webbing material stitched and glued together. A plurality of gripping cleats protruding through a hole seared through one of the outer layers of the webbing material provide an improved gripping means when the device is placed between the inner surface of a conventional safety lanyard or belt and the pole. The ends of the belt are seared to prevent the belt from fraying. The assembled belt is held in place on the inner surface of a safety lanyard or belt by a plurality of VELCRO hook and loop fastener straps with one being placed on each of the belts ends and at least one other placed therebetween.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

| LIST OF REFERENCE NUMBERS | |
|---|---|
| 10 | Pole Hitching Device |
| 20 | Multi-Layer Strap |
| 20a | Inner Layer |
| 20b | Middle Layer |
| 20c | Outer Layer |
| 30 | Gripping Cleats |
| 40 | Velcro Straps |
| 50 | Conventional Safety Lanyard or Belt |

DESCRIPTION OF THE PREFERRED EMBODIMENTS

The best mode for carrying out the invention is presented in terms of its preferred embodiment, herein depicted within the Figures.

1. Detailed Description of the Figures

Figure 1:
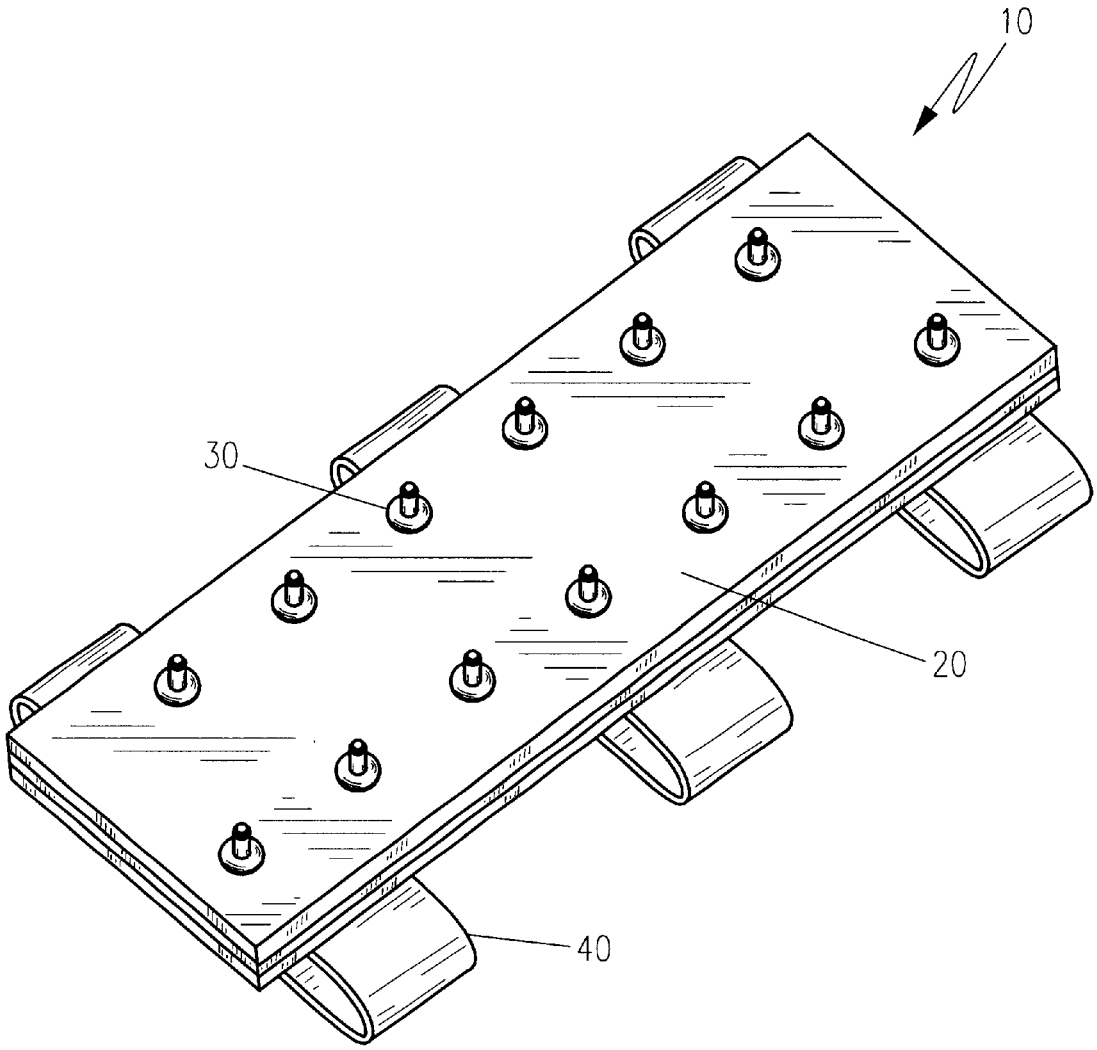
FIG. 1 is a perspective view of a pole hitching device according to the preferred embodiment of the present invention.

Referring now to FIG. 1, a preferred embodiment of pole hitching device 10 is shown comprised of a multi-layer strap 20 comprised of an inner layer 20*a*, a middle layer 20*b*, and an outer layer 20*c*. In another embodiment, additional layers of webbing may be added to improve strength. A plurality of evenly spaced gripping cleats 30 placed in two rows line the inner layer of strap 20. Cleats 30 are generally cylindrical in shape having a tip at one end and a disc shaped perpendicular base at the other. The cleats 30 are installed through an aperture formed through inner layer 20*a* by searing with a hot slender cylindrical object. The tip end of cleat 30 is inserted while the webbing material of Inner Layer 20*a* is still hot. Cleat 30 is pushed completely through said aperture until the perpendicular base of cleat 30 fits snugly against the outer surface side of said Inner Layer 20*a*. The now cooling webbing material will thereby tightly grip and hold said Cleat 30 as it shrinks. Middle Layer 20*b* is then glued to inner layer 20*a* on its outer surface side. Outer layer 20*c* is then glued to the resulting assembly and the entire assembly is stitched tightly together. Both ends of the resulting strap 20 assembly are then seared to prevent fraying and unraveling of the webbing material. The webbing can be made from any type of material considered durable but this may include nylon or canvas. Hook and loop fastener Velcro straps 40 are then sewn onto strap 20 at both ends and at least one other additional strap sewn therebetween. The size of the device 10 may vary but generally the device 10 is twelve to eighteen inches long and two to three inches wide. The number of gripping cleats 30 may also vary but generally there may be from twelve to twenty five gripping cleats 30 spaced evenly along two rows bordering the edge of the device 10. The gripping cleats 30 may also vary in size in terms of length and diameter but generally the gripping cleats 30 may be from three quarters of an inch to one and a half inches in length and a quarter of an inch and upwards in diameter.

Figure 2:
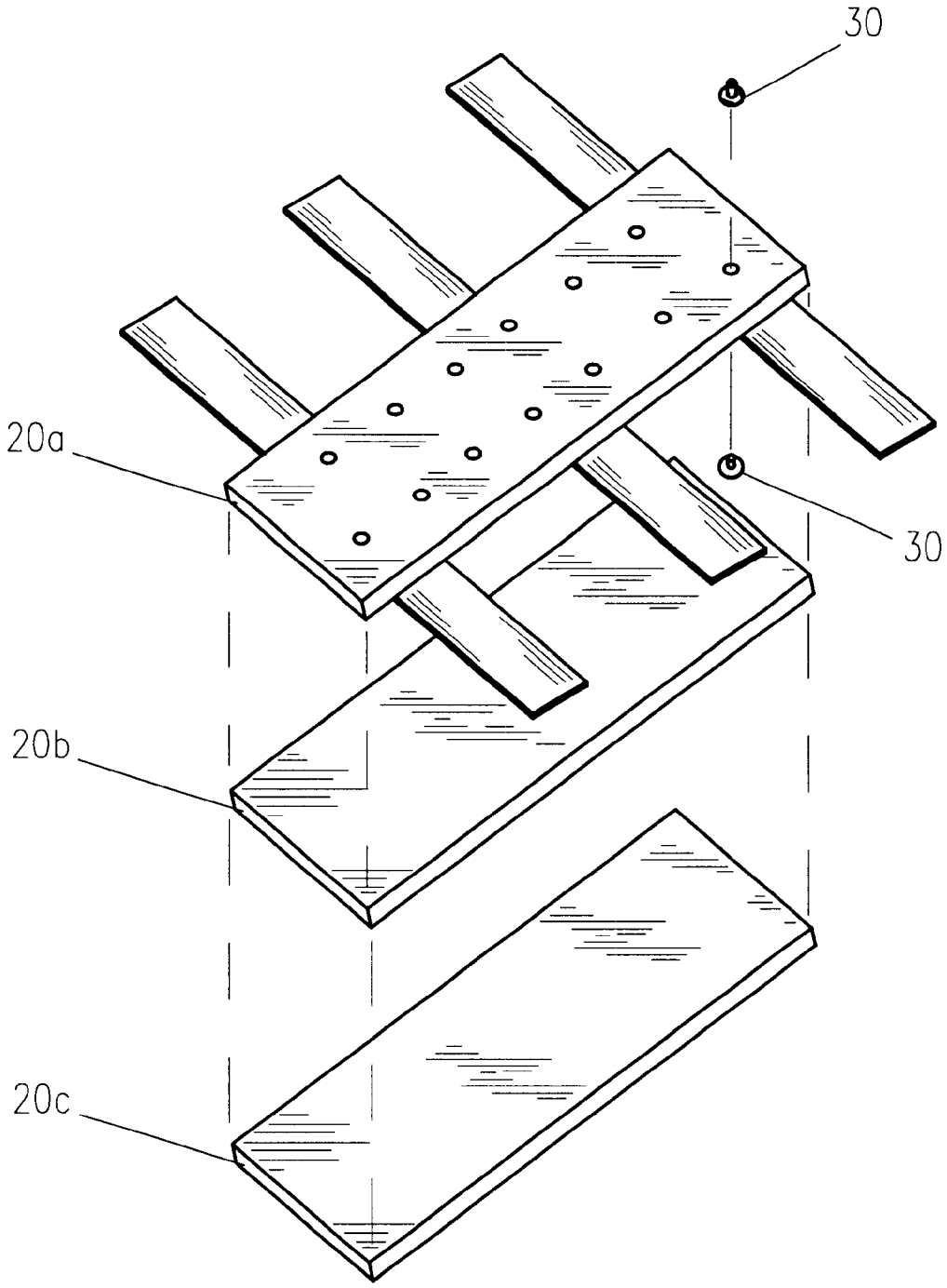
FIG. 2 is an exploded perspective view showing the detail of the multi-layer webbing and the gripping cleat pressed between a middle layer and outer layer according to the preferred embodiment of the present invention.

Referring to FIG. 2, shown is an exploded perspective view of a pole hitching device 10 showing the detail of the placement of gripping cleat 30 through an aperture formed through inner layer 20*a*.

Figure 3:
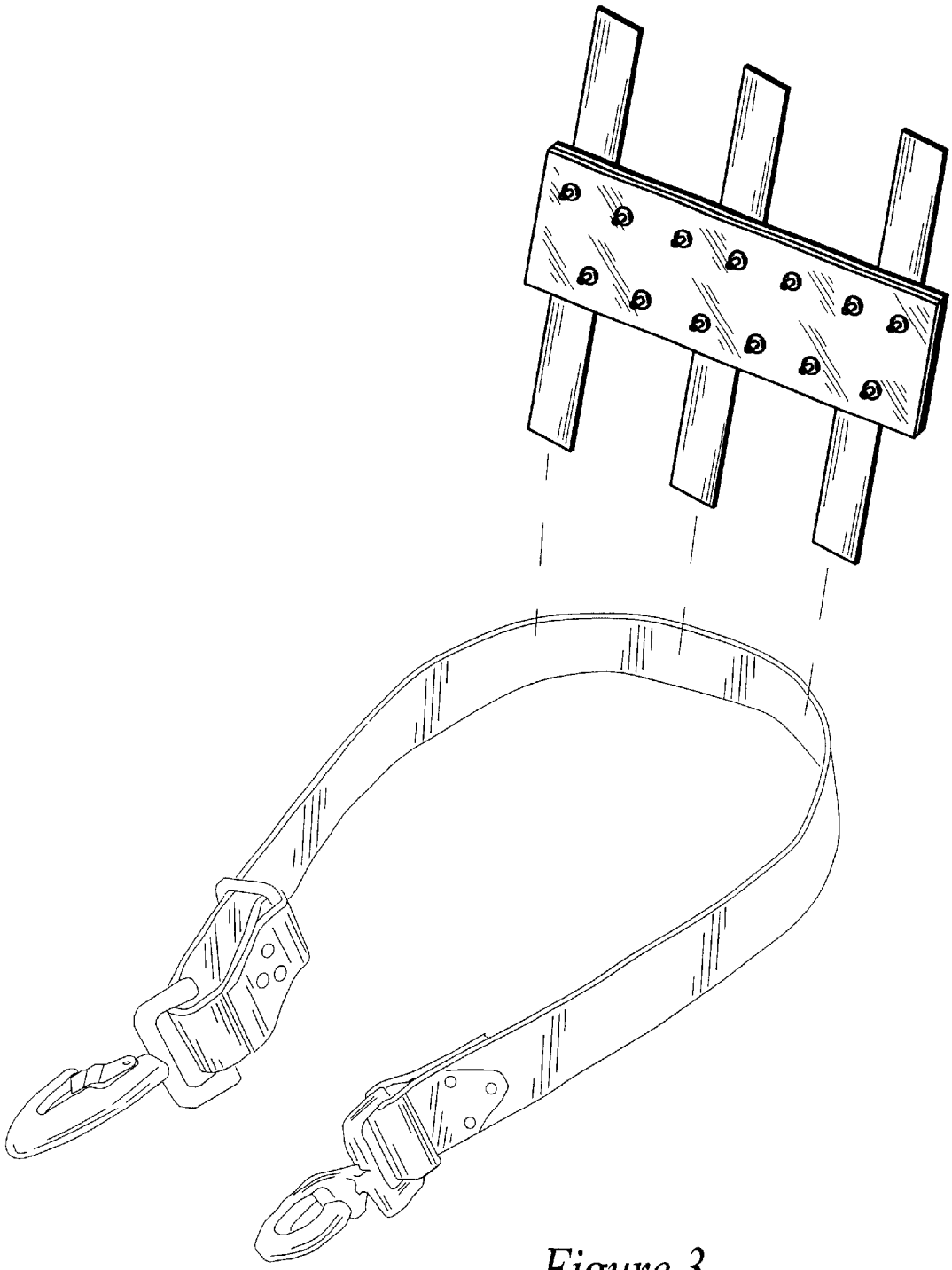
FIG. 3 is an exploded view of a pole hitching device for use in conjunction with a conventional safety lanyard or belt according to the preferred embodiment of the present invention.

Referring to FIG. 3, shown is an exploded perspective view of a pole hitching device 10 showing how it may be removably installed on a conventional safety lanyard or belt 50.

Figure 4:
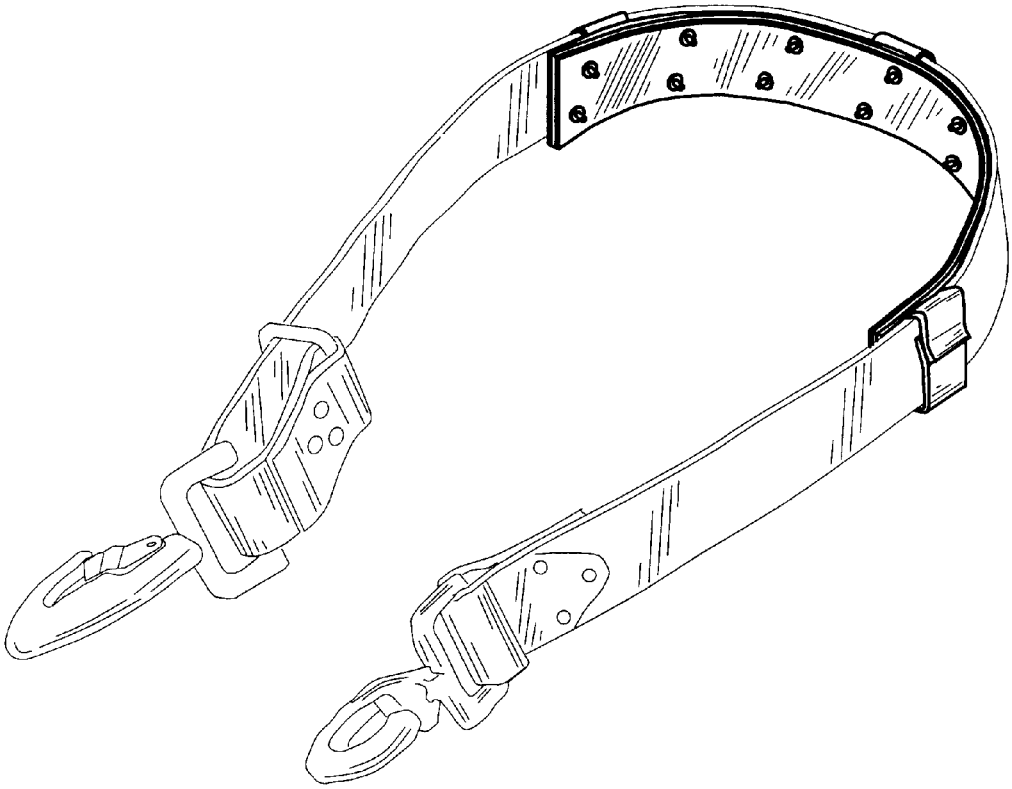
FIG. 4 is a perspective view of a pole hitching device installed on a conventional safety lanyard or belt according to the preferred embodiment of the present invention.

Referring to FIG. 4, shown is a perspective view of pole hitching device 10 fastened on the inner surface of a conventional safety lanyard or belt 50 by Velcro straps 40.

Figure 5:
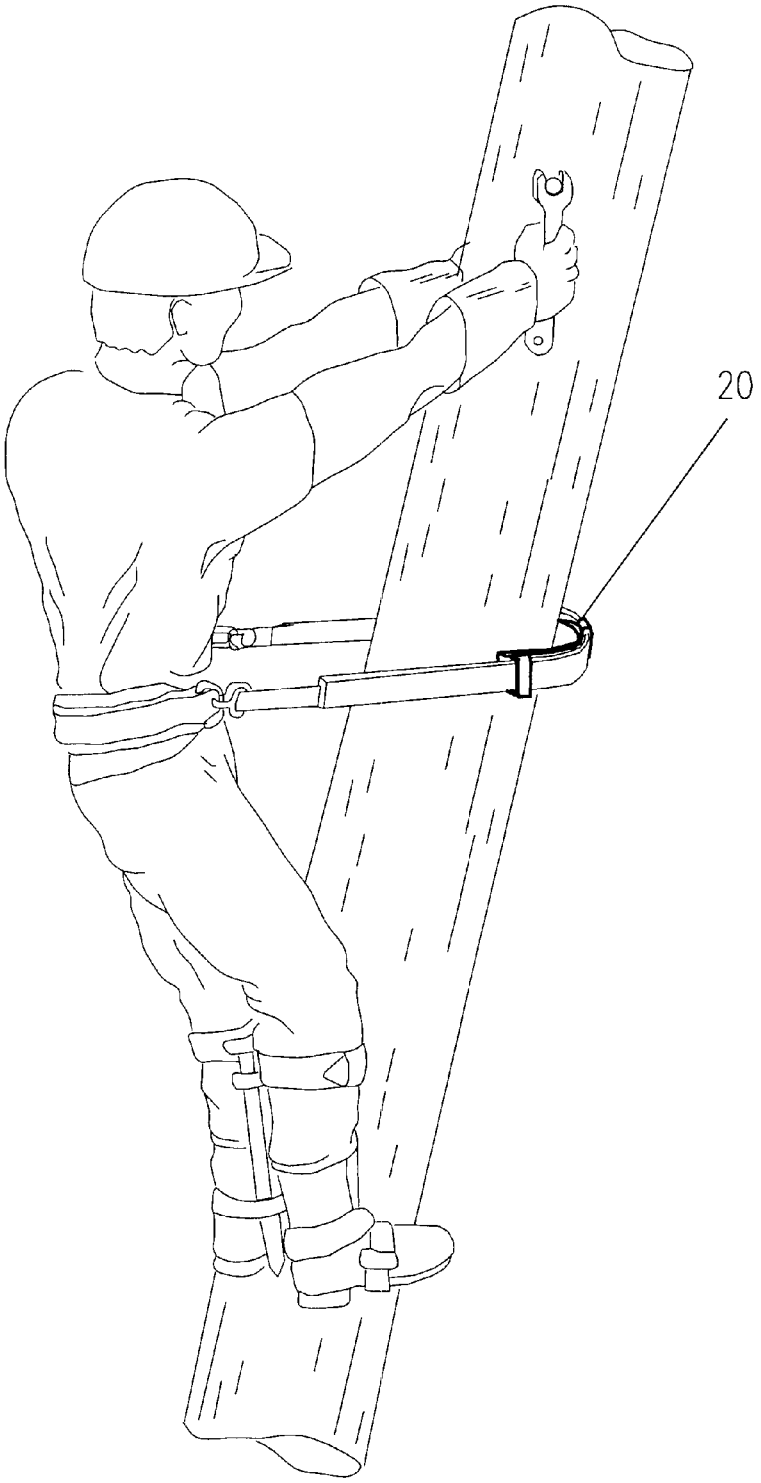
FIG. 5 is a perspective view of the intended use of a pole hitching device installed on a conventional safety lanyard or belt according to the preferred embodiment of the present invention.

Referring to FIG. 5, shown is a perspective view of the contemplated use of the pole hitching device 10 in conjunction with a conventional safety lanyard or belt 50 by a pole climber.

Figure 6:
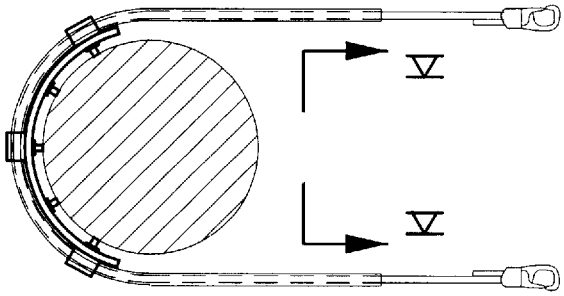
FIG. 6 is a cross sectional view of the placement of a pole hitching device on a conventional safety lanyard or belt placed against a pole according to the preferred embodiment of the present invention.

Referring to FIG. 6, shown is a top view of pole hitching device 10 and conventional safety lanyard or belt 50 and their intended usage shown around a cut away cross sectional view of a typical pole taken along line V—V of FIG. 5. The pole hitching device 10 is attached to the inner surface of the conventional safety lanyard or belt 50 by use of Velcro straps 40. Gripping cleats 30 protruding from said pole hitching device 10 grip the surface of said pole allowing a climber to support his weight or a portion thereof for balance as he works on the pole, climbs or descends it.

Figure 7:
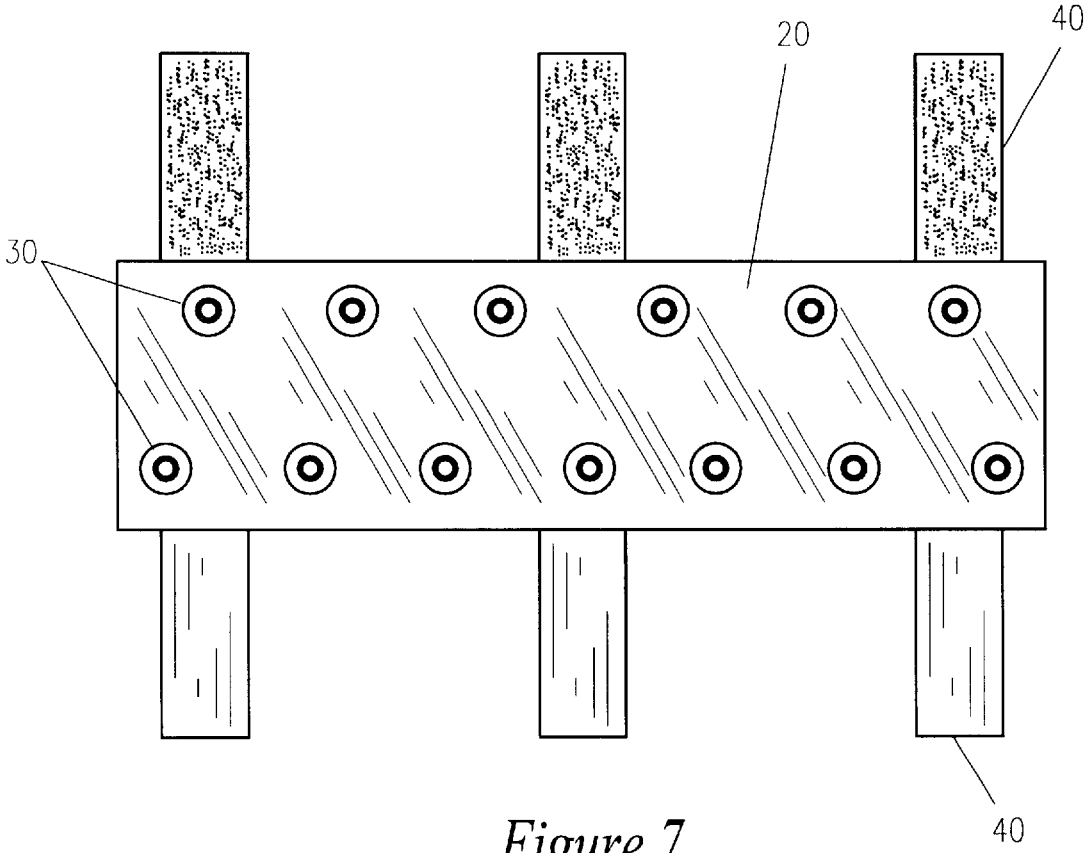
FIG. 7 is a front view of a pole hitching device according to the preferred embodiment of the present invention.

Referring to FIG. 7, a top view of pole hitching device 10 is shown with Velcro straps 40 in the unfastened position.

Figure 8:
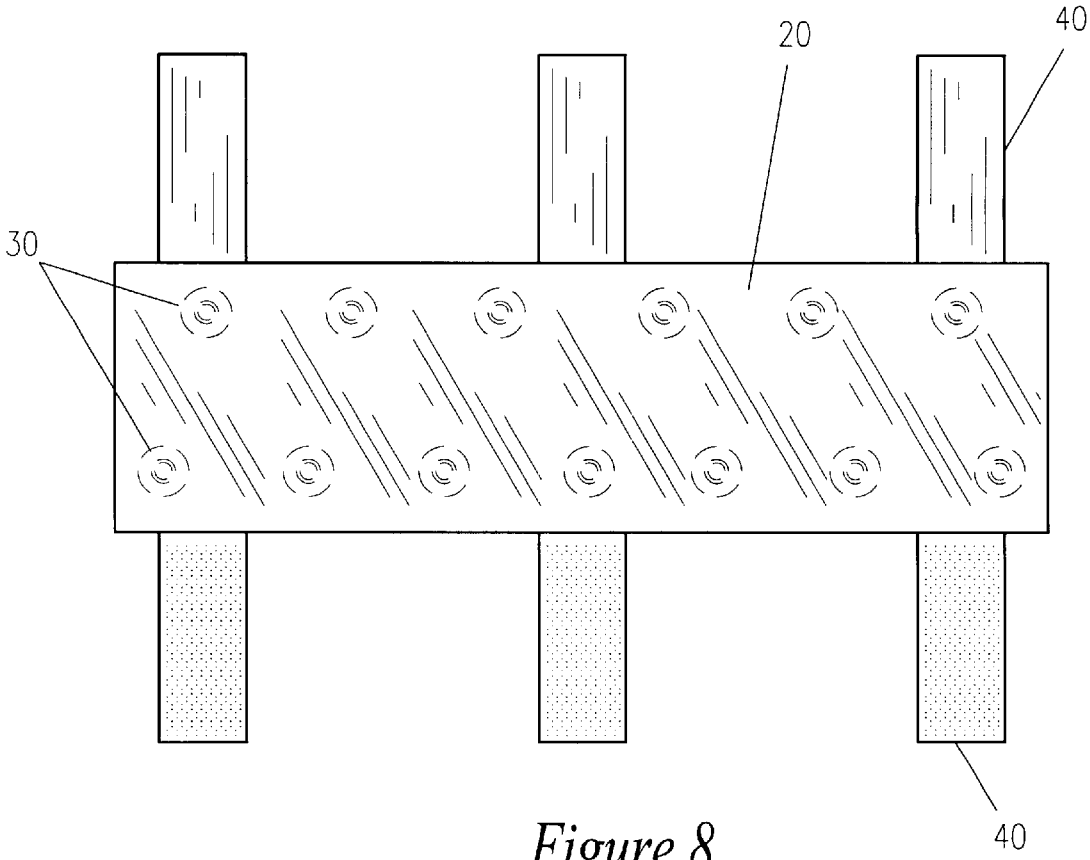
FIG. 8 is a rear view of a pole hitching device according to the preferred embodiment of the present invention.

Referring to FIG. 8, shown is a bottom view of pole hitching device 10 showing the base of gripping cleat 30 enmeshed between the layers of web material comprising the device.

Figure 9:
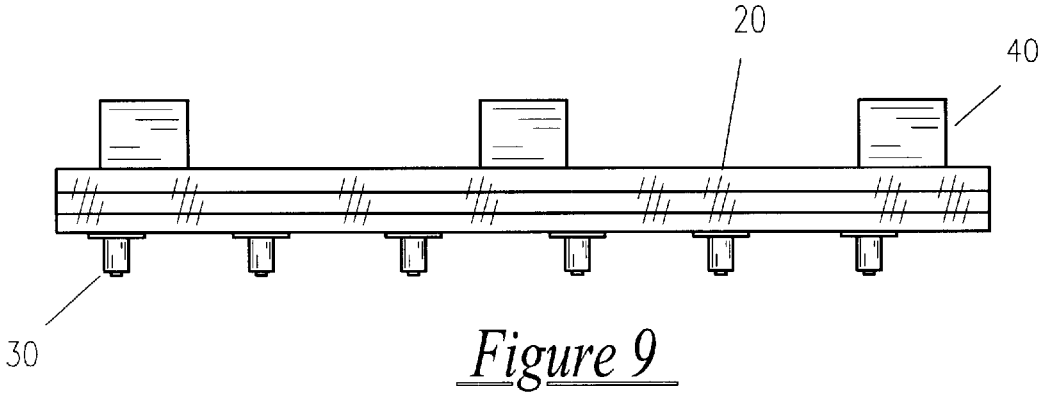
FIG. 9 is a top view of a pole hitching device according to the preferred embodiment of the present invention.

Referring to FIG. 9, a pole hitching device 10 is shown showing gripping cleats 30 extending from said device 10 and the general contour of said gripping cleats. In another embodiment, another contour may be chosen to optimize the gripping effect the cleats 30 have with the pole surface.

2. Operation of the Preferred Embodiment

To utilize the pole hitching device, a climber fastens the pole hitching device 10 to the inner surface of a conventional safety lanyard or belt 50 by use of Velcro hook and loop fastner straps 40. The climber then places the lanyard 50 around the pole and fastens the end of the lanyard 50 to another belt he is wearing. To begin climbing, the climber places the entire assembly some distance above the plane of his waist. By utilizing his body weight, the climber pulls the lanyard 50 against the pole forcing the lanyard 50 and gripping cleats 30 into the pole. With his boots, the climber simultaneously attempts to climb the pole. Between the efforts of his feet and pulling on the lanyard 50 the climber can effectively scale the pole. Once at a desired height the climber can also utilize the assembly to support his weight in conjunction with his feet to attend to other tasks. By reversing the process, the climber can also descend from the pole.

What is claimed is:

1. A pole climber safety lanyard having a pole hitching device, wherein said pole hitching device comprises an elongated strap with gripping cleats attached to and extending along an inner surface at an intermediate portion of said safety lanyard for the cleats to extend toward and grip a side of a pole opposite top a pole climber, wherein said pole hitching device comprising a multi-layer strap, said strap having an inner layer, a middle layer and an outer layer, a plurality of evenly spaced said gripping cleats, said cleats placed such as to line said inner layer, said cleats are generally cylindrical having a first end opposite a second end, each cleat further having a tip at said first end and a disc shaped perpendicular base at said second end, said cleats are installed through apertures formed through said inner layer by searing with a hot slender cylindrical object, the tip ends of said cleats thereafter inserted while said inner layer is still hot and said cleats pushed completely through said apertures until the perpendicular bases of said cleats fit snugly against an outer surface side of said inner layer, wherein upon cooling of said inner layer said cleats are thereby tightly gripped and held, further comprising a plurality of hook and loop fastener straps extending transversely to and attached to said outer layer of said elongated strap, said hook and loop fastener straps attaching said pole hitching device to said safety lanyard.

* * * * *